United States Patent [19]

Muller et al.

[11] 4,232,803

[45] Nov. 11, 1980

[54] BULK MATERIAL RETAINING SYSTEM HAVING PLURAL RETAINERS

[75] Inventors: George H. Muller, Ann Arbor; William T. Downs, Howell, both of Mich.

[73] Assignee: A.I.R. Foundation, Ann Arbor, Mich.

[21] Appl. No.: 957,773

[22] Filed: Nov. 6, 1978

Related U.S. Application Data

[63] Continuation of Ser. No. 758,386, Jan. 10, 1977, abandoned.

[51] Int. Cl.[3] ..... B65D 35/28

[52] U.S. Cl. ..... 222/105; 220/404; 222/183

[58] Field of Search ..... 222/105, 131, 143, 183, 222/185; 160/229 R, 231; 220/63, 401, 404; 105/423; 296/39 R

[56] References Cited

U.S. PATENT DOCUMENTS

| | | | |
|---|---|---|---|
| 96,386 | 11/1869 | Bishop | 160/229 R X |
| 2,596,714 | 5/1952 | Nonell | 160/231 R X |
| 3,386,605 | 6/1968 | LaFont | 222/183 X |
| 3,537,687 | 11/1970 | Adelman | 160/229 R X |
| 3,578,213 | 5/1971 | Clarke | 222/183 X |
| 3,580,322 | 5/1971 | Herbert et al. | 160/231 |
| 3,696,952 | 10/1972 | Bodenheimer | 206/527 X |
| 3,951,284 | 4/1976 | Fell et al. | 296/39 R X |
| 4,124,136 | 11/1978 | Bjelland et al. | 222/105 X |

*Primary Examiner*—Robert J. Spar
*Assistant Examiner*—Fred A. Silverberg
*Attorney, Agent, or Firm*—Whittemore, Hulbert & Belknap

[57] ABSTRACT

A system for transporting bulk material, including a container having a top, bottom, left and right sides, a front end and a back end, comprising a pair of doors which are hinged on one edge at the back end of the sides of the container and meet at the other edge in a closed condition, a first vertical retainer positioned on the bottom and extending toward the top of the container, one end of which is wedged against the right side of the container in spaced relation to the back end thereof, the other end of which is positioned against the free end of the left door in a closed position, and a second retainer which is positioned on the bottom of the container and is inclined outwardly toward the left door of the container and toward the left side thereof, having one end wedged against the left side of the container and the other end positioned against the lower portion of the first retainer and the left door of the container, a flexible liner supported within the container, one end of which abuts the retainers, sleeves for passing bulk material into the liner and evacuating air from the liner, and a manifold for removing bulk material from the liner through the first retainer.

19 Claims, 18 Drawing Figures

FIG.1
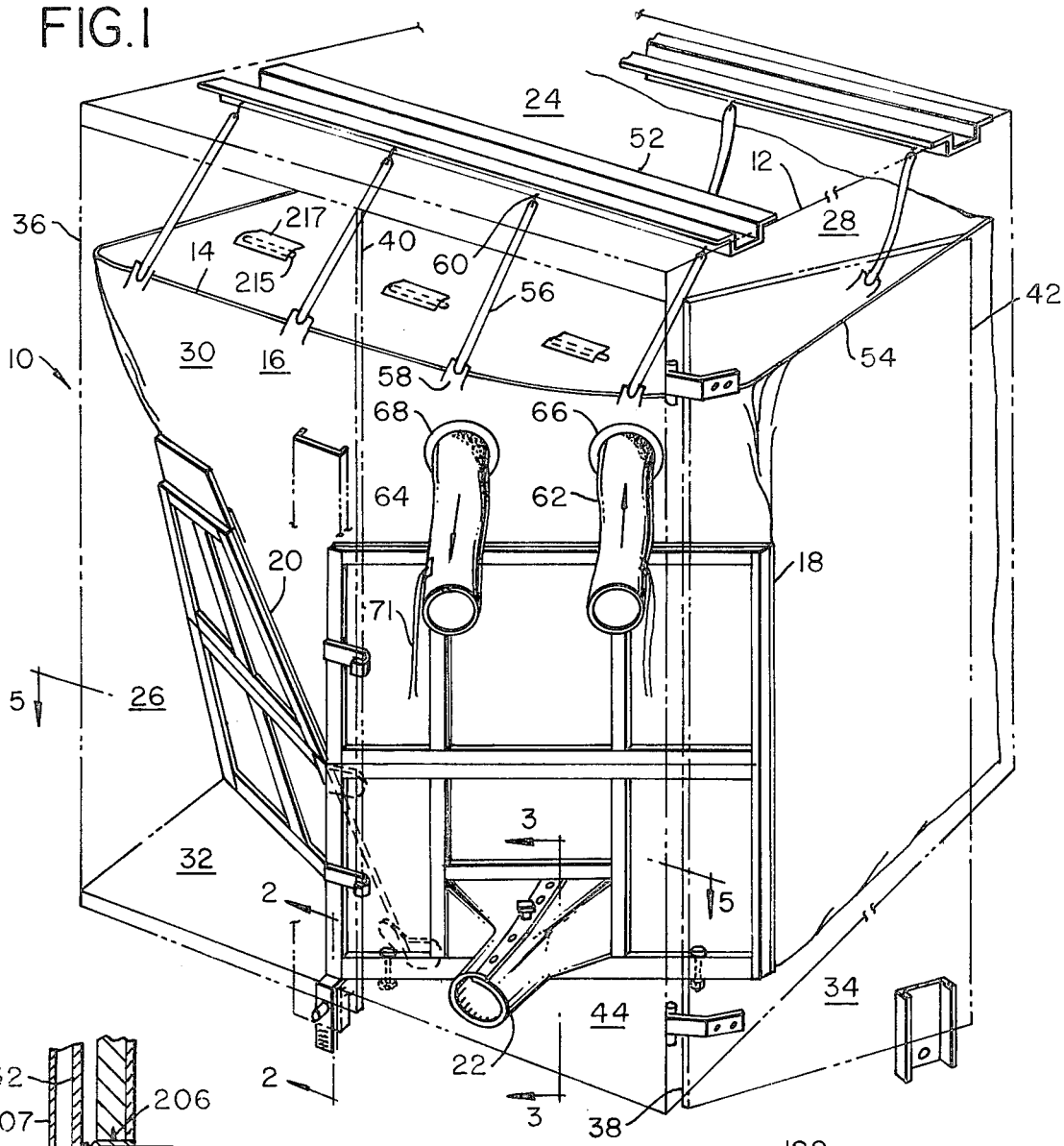
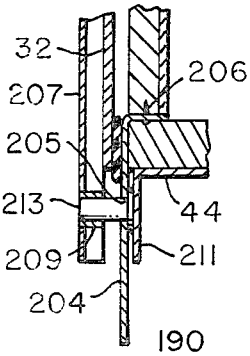
FIG.2
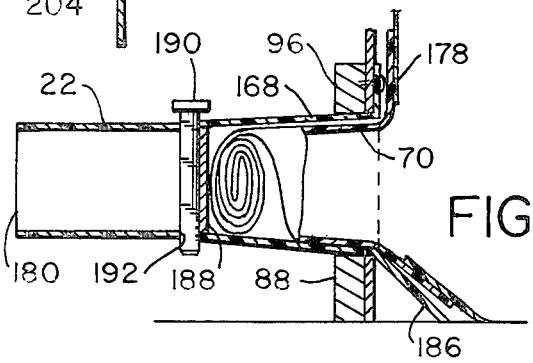
FIG.3
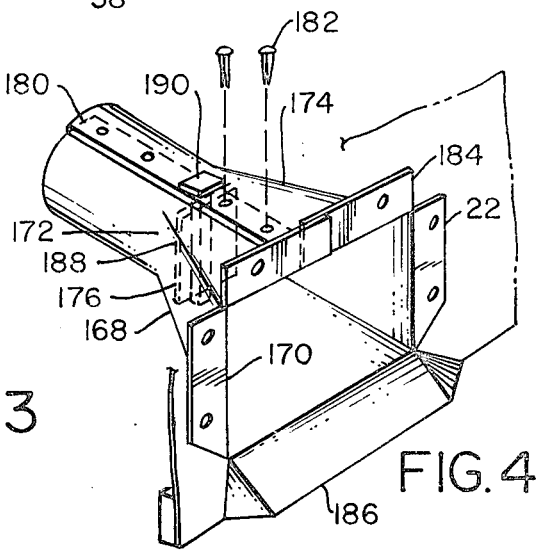
FIG.4

FIG.6
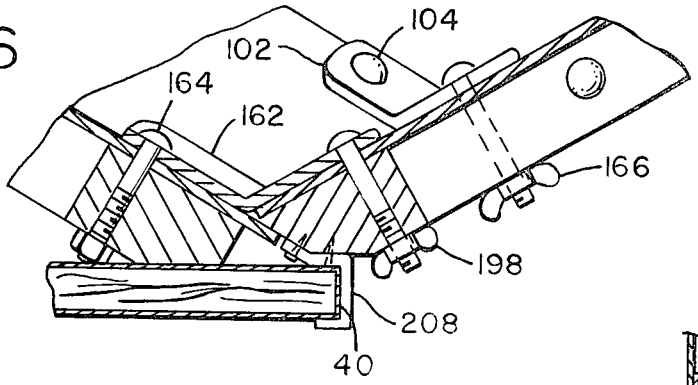
FIG.5
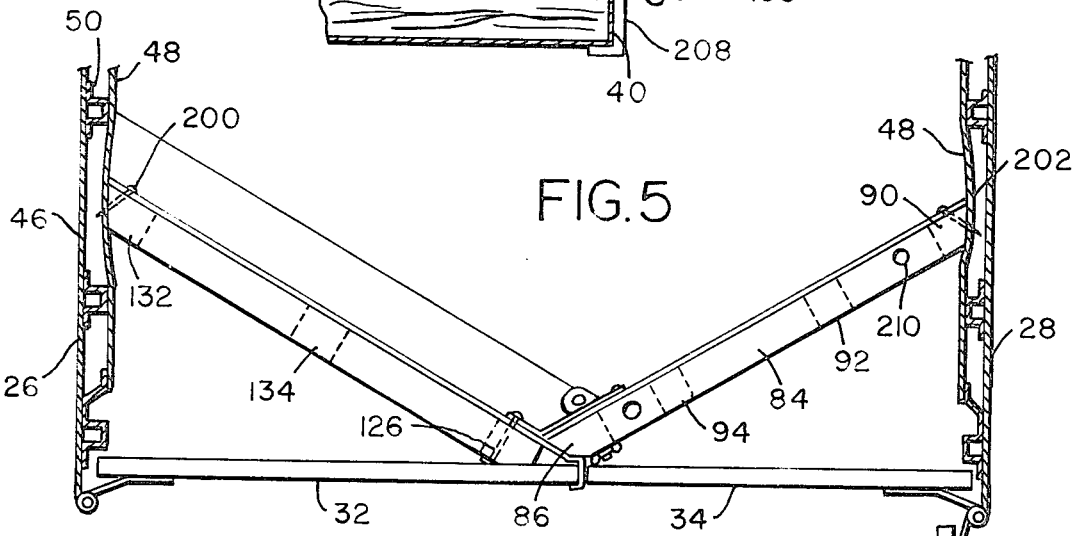
FIG.7
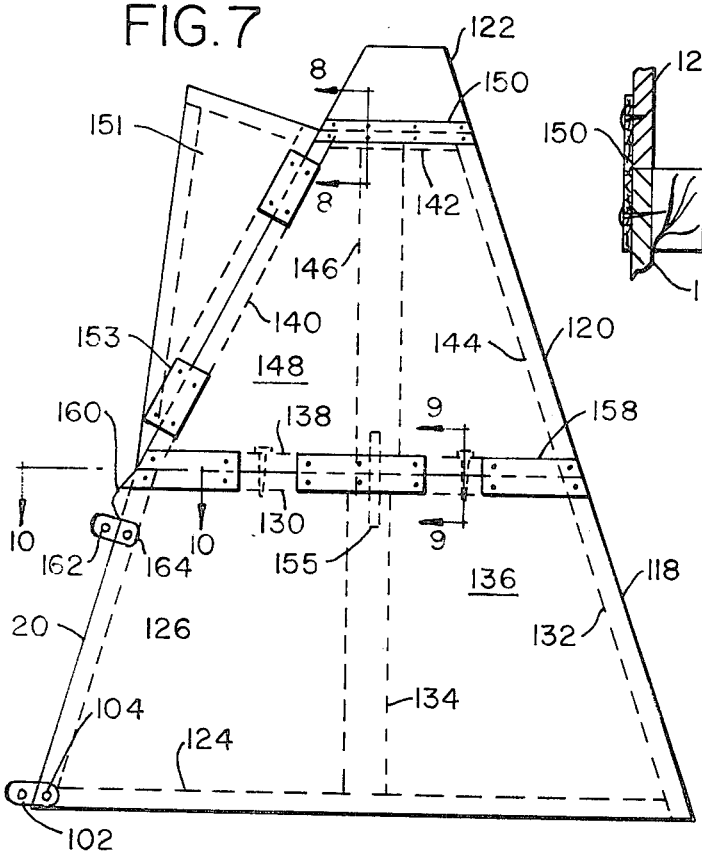
FIG.8
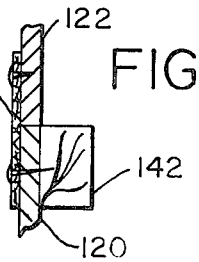
FIG.9
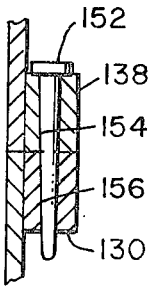
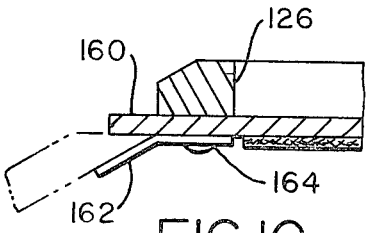
FIG.10

FIG.11
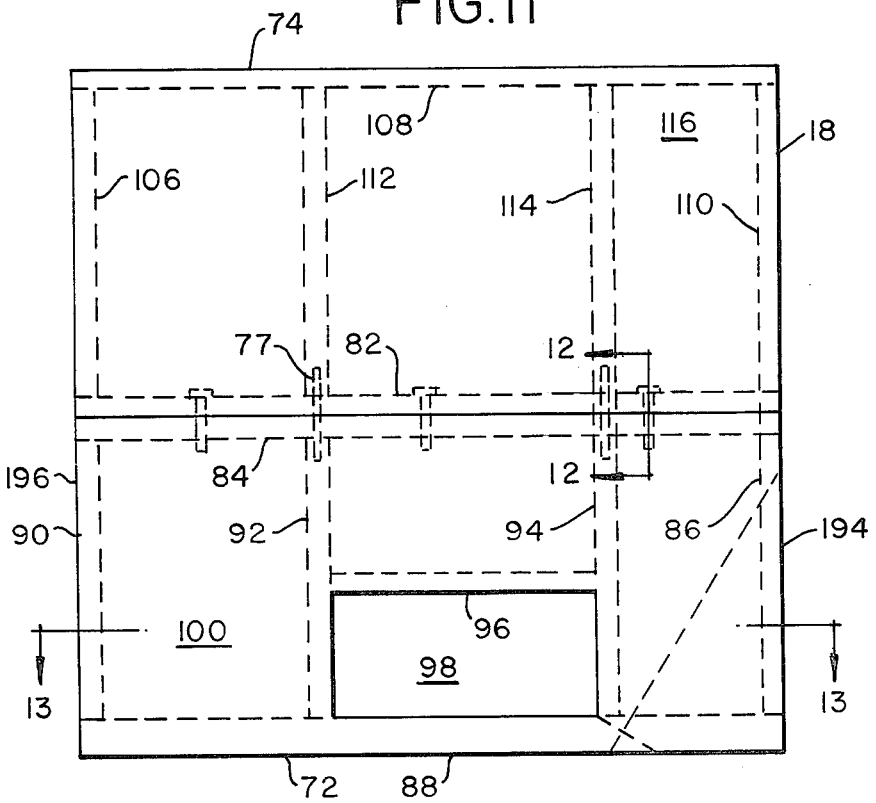
FIG.12
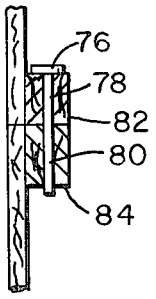
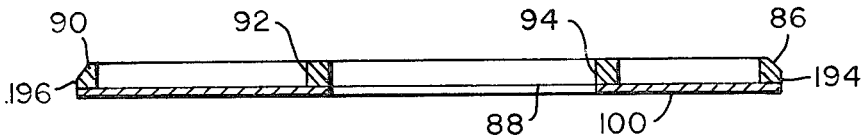
FIG.13
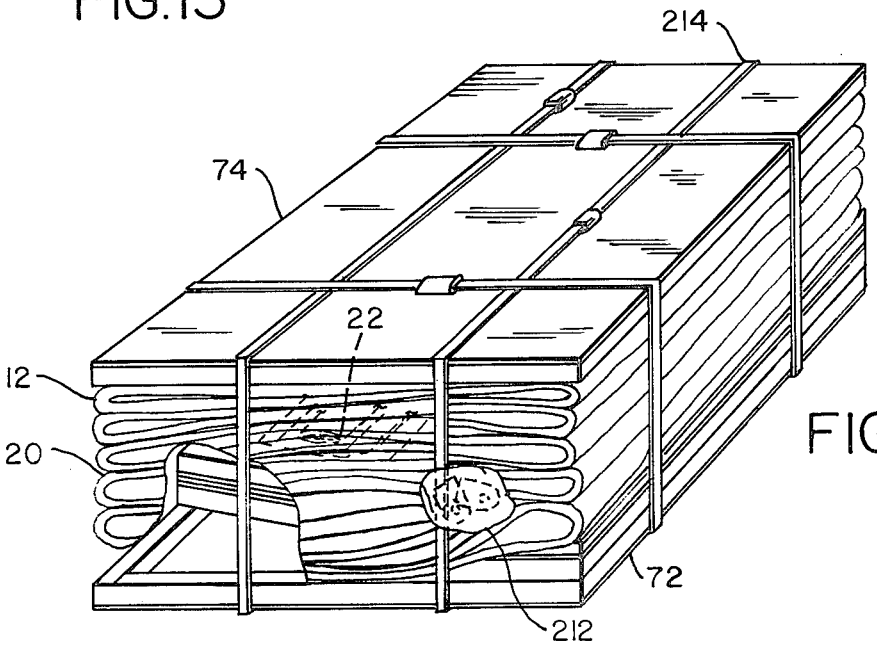
FIG.14

FIG.16
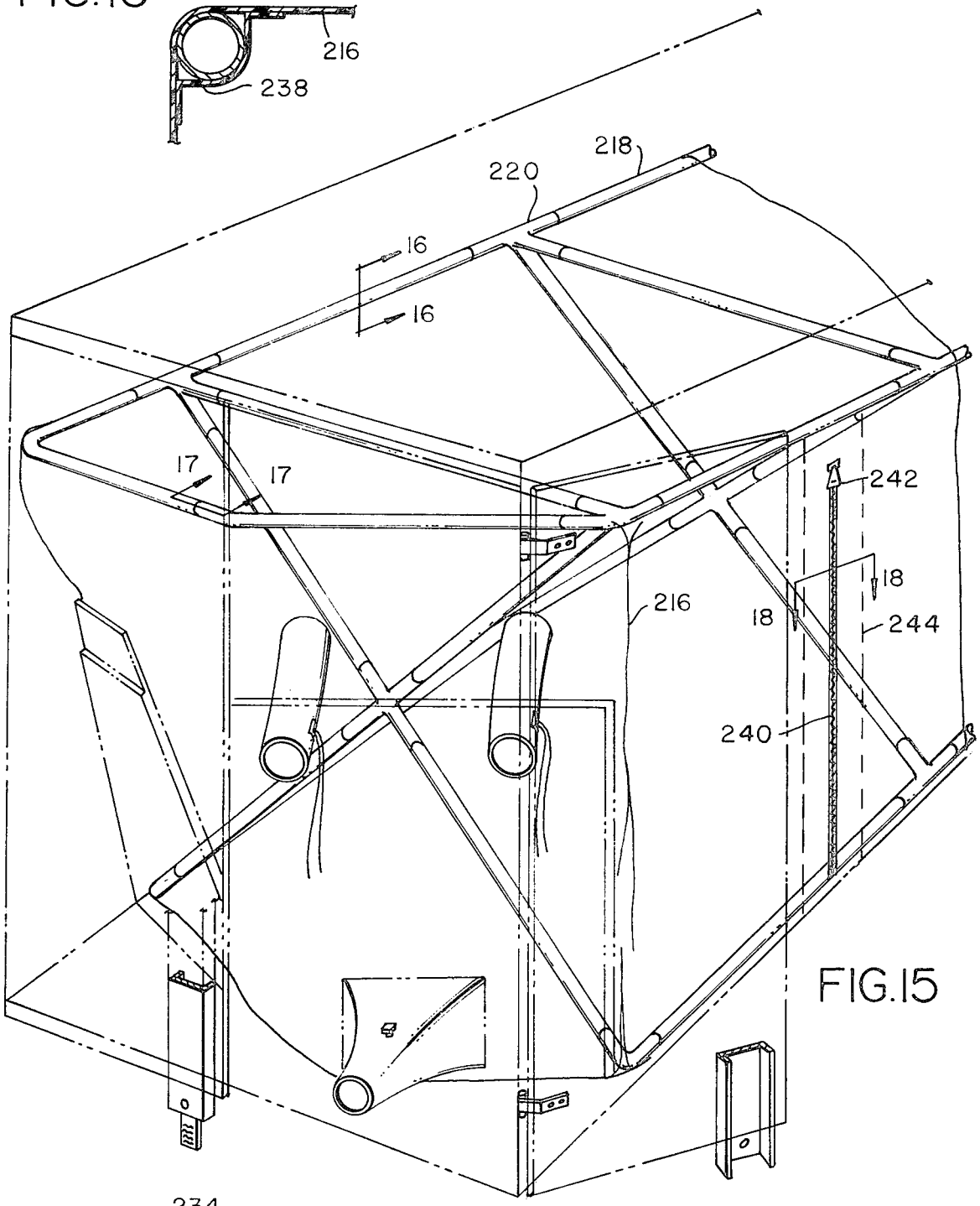
FIG.15
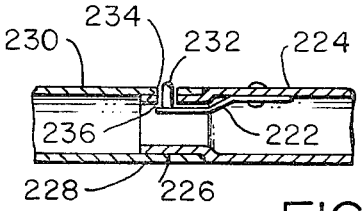
FIG.17
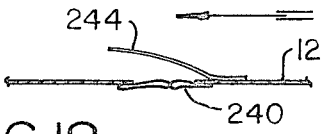
FIG.18

BULK MATERIAL RETAINING SYSTEM HAVING PLURAL RETAINERS

This is a continuation of application Ser. No. 758,386 filed Jan. 10, 1977 now abandoned.

BACKGROUND OF THE INVENTION

1. Field of the Invention

The invention relates to transporting bulk material and refers more specifically to a system for transporting bulk material in a container including unique retainer structure for retaining the end of a flexible liner supported in the container, which system is capable of being packaged for commercial air shipment as baggage. A unique tubular frame for supporting the liner within the container is utilized in one modification of the system.

2. Description of the Prior Art

In the past, structure for transporting bulk material has been described in U.S. Pat. Nos. 3,386,605, 3,696,952, 3,868,042 and 3,951,284. Such structure in general includes a flexible liner positioned within a container, one end of which is secured in the container by a retainer.

Prior liner structure has been secured to the container by adhesive on the side walls of the container and/or by resilient straps secured to the top of the container and secured to the liner. The adhesive material is messy to clean up and is, therefore, objectionable. The straps are objectionable in that they must be manufactured with the liner or may become lost from the liner. Also, considerable time is required in hanging the liner from the straps.

Further, prior structure for transporting bulk material has included a single retainer extending across the entire end of a container and as a result has been relatively heavy, difficult to transport for re-use, and expensive. Further, prior retainers have sometimes been constructed integrally with liners and are therefore not generally reusable. Also, in the prior art, structure for removing the bulk material from the container has not been sufficiently rigid to permit ready removal of bulk material from the container and has not been so positioned in relation to the retainer and the positioning of the retainer to permit complete emptying of the liner within the container readily.

SUMMARY OF THE INVENTION

In accordance with the invention, there is provided a system for shipping bulk material in containers such as large truck bodies or the like, including front, back, left and right sides, top and bottom, with the back being a pair of doors, pivotally mounted on the back ends of the sides, and having free edges positioned generally centrally of the back of the container with the doors closed. The system includes a plastic liner having substantially the same dimensions as the inside of the container, which plastic liner may be supported from the container top by flexible and/or elastic straps. Alternatively, the plastic liner may be supported from a tubular frame constructed within the plastic liner. In either case, the plastic liner includes openings for delivery of bulk material into the liner and for exhausting of air out of the liner, and an opening for removal of the bulk material from the liner. The plastic liner may also have an inspection opening sealed by a zipper or the like through which entrance into the liner is effected for erection of the tubular frame.

The end of the plastic liner adjacent the back end of the container is supported by a pair of retainers. The first retainer is positioned vertically between the inner edge of the left door in a closed position and the right side of the container in spaced relation to the back end of the right side wall and consists of two separate portions positioned one on top of the other, connected by vertically extending pins in assembly. The second retainer is positioned to slant outwardly of the back of the container and toward the left side thereof, one end of the second retainer is engaged with the lower portion of the first retainer and with the left door of the container, the other end of the second retainer is engaged with the left side of the container in spaced relation to the back end of the left side. The second retainer includes upper and lower portions secured together by means of both pins and flexible hinges, and a flap which is secured to the top of the upper portion by means of a flexible hinge only. In one modification, a second flap is secured to the side of the upper portion of the second retainer by flexible hinges.

The first and second retainers are secured together by a pair of brackets secured to the second retainer at the top and bottom thereof and adapted to be secured to the first retainer. In addition, a tab extends from the right end of the second retainer behind the left end of the first retainer in assembly.

A number of different structures are provided for securing the left end of the first retainer against the left door of the container, including a plastic tab secured to the bottom of the left end of the first retainer, and extending downwardly between the bottom and left door of the container in a closed position. Hook-shaped straps may also be secured to the left end of the first retainer and secured thereto, which straps also extend around the free edge of the left door of the container in a closed position. In a third modification, bolts extend through the bottom of the first retainer and through the floor of the container.

A manifold is secured to the first retainer over an opening therein at the bottom thereof through which bulk material may be removed from the container. The manifold which is constructed of relatively rigid foldable material which is precut and pre-creased to fold into a desired manifold configuration having a rectangular end at the opening in the first retainer merging into a cylindrical end at the back of the container is secured to the first retainer by convenient means such as screws, and is assembled by convenient means such as French pins. A plug is positioned in the rectangular portion of the manifold and is held in position thereby by a pin. On removal of the pin, the plug may be removed through the manifold to permit unloading of the bulk material through the manifold.

The ends of the two retainers at the sides of the container are wedged in position against the sides of the container and may be positively secured against the sides of the container.

The first retainer in a disassembled condition, the second retainer in a folded condition, the manifold in an expanded flat condition, the liner, and the hardware necessary to support the liner and to construct the retainer and manifold in the field, are packaged into a single package having dimensions not greater than $60 \times 30 \times 25$ inches for shipment to the point of use.

BRIEF DESCRIPTION OF THE DRAWINGS

FIG. 1 is a perspective view of a system for shipping bulk material, constructed in accordance with the invention, showing the actual container in phantom.

FIG. 2 is an enlarged section view of a portion of the structure illustrated in FIG. 1, taken substantially on the line 2—2 in FIG. 1.

FIG. 3 is an enlarged section view of a portion of the structure illustrated in FIG. 1, taken substantially on the line 3—3 in FIG. 1.

FIG. 4 is a partially exploded perspective view of the manifold structure illustrated in FIG. 1.

FIG. 5 is a partial cross section of the structure illustrated in FIG. 1, taken substantially on the line 5—5 in FIG. 1.

FIG. 6 is an enlarged view of a portion of the structure illustrated in FIG. 5.

FIG. 7 is an elevation view of a modified left retainer as illustrated in FIG. 1.

FIG. 8 is an enlarged section view of the retainer illustrated in FIG. 7, taken substantially on the line 8—8 in FIG. 7.

FIG. 9 is an enlarged section view of the retainer illustrated in FIG. 7, taken substantially on the line 9—9 in FIG. 7.

FIG. 10 is an enlarged section view of the retainer illustrated in FIG. 7, taken substantially on the line 10—10 in FIG. 7.

FIG. 11 is an elevation view of the right retainer illustrated in FIG. 1.

FIG. 12 is an enlarged section view of the retainer illustrated in FIG. 11, taken substantially on the line 12—12 in FIG. 11.

FIG. 13 is a section view of the retainer illustrated in FIG. 11, taken substantially on the line 13—13 in FIG. 11.

FIG. 14 is a packaged view of the retainers illustrated in FIGS. 7 and 11, the manifold illustrated in FIG. 4, the plastic liner illustrated in FIG. 1, and the hardware incident thereto, ready for shipment to a point of use.

FIG. 15 is a perspective view of tubular frame structure for internally supporting a plastic liner in container structure as illustrated in FIG. 1.

FIG. 16 is an enlarged partial section view of the structure illustrated in FIG. 15, taken in the direction of arrows 16—16 in FIG. 15.

FIG. 17 is an enlarged partial section view of the structure illustrated in FIG. 15, taken in the direction of arrows 17—17 in FIG. 15.

FIG. 18 is an enlarged partial section view of the structure illustrated in FIG. 15, taken in the direction of arrows 18—18 in FIG. 15.

DESCRIPTION OF THE PREFERRED EMBODIMENT

As shown best in FIG. 1, the system 10 for retaining bulk material within a container 12, in accordance with the invention, includes the liner 14. The liner structure 14 is supported during transit at the back end 16 thereof by a first or right retainer 18 and a second or left retainer 20. Manifold structure 22, through which bulk material is emptied from the container, is supported by the retainer 18.

Container 12, which may be for example the body of a truck, includes the top 24, the left side 26, the right side 28, a back 30 including a left door 32 and a right door 34 pivoted about their left and right edges 36 and 38, respectively, and having swinging or free edges 40 and 42, respectively. Usual means are provided for releasably locking the doors 32 and 34 in a closed position. The container 12 further includes a floor 44 and a closed front end (not shown).

As shown best in FIG. 5, the left and right sides 26 and 28 of the container may be constructed to have an outer aluminum skin 46 and an inner plywood liner 48 separated by vertically extending structural shapes 50. The top 24 of the container may include structural reinforcing shapes 52, as shown best in FIG. 1, as needed, which have openings therein to permit hanging of the liner 14 therefrom. Floor 44, doors 32 and 34, and the front end of the container 12 may be similarly constructed of panels which may be reinforced by channels having structural shapes, as desired.

The liner structure 14, as shown best in FIG. 1, includes a large plastic liner 54 having left and right sides, top, bottom, front and back ends, adjacent the corresponding portions of the container 12. In the structure of FIG. 1, the liner 54 is supported from the top 24 of the container 12 through the flexible straps 56 secured at one end to tabs 58 of the liner 54 and secured to the structural shapes 52 of the top 24 at the other end by convenient means such as hooks 60.

Sleeves 62 and 64 are provided on the right side of the back 16 of the liner 54 in the opening provided by the door 34, as shown best in FIG. 1. Sleeves 62 and 64 include flanges 66 and 68 by which they may be heat sealed or otherwise secured around openings in the liner 54. The sleeves 62 and 64, which may be of relatively thin plastic material such as polyethylene, the same as the liner 54, are provided for feeding bulk material into the liner 54 and for permitting escape of air from the liner 54, respectively. The liner 54 includes a similar sleeve 70 which extends into the manifold 22, as shown best in FIG. 3. Bulk material is removed from liner 54 through sleeve 70 and manifold 22. Ties are taped to sleeves 62, 64 and 70 for closing the sleeves as desired.

Alternatively, reinforced openings including conventional drawstring closure means or a flap cover for the opening which may be closed by a peripheral zipper or the like may be substituted for the sleeves 62, 64 and/or 70.

Retainer 18, as shown best in FIG. 11, includes a separate lower portion 72 and upper portion 74. In assembly, the upper portion 74 is secured to the lower portion 72 by means of headed pins 76 adapted to extend through aligned openings 78 and 80 in the adjacent peripheral frame members 82 and 84, respectively. Pins 77 are also provided, each end of which extend into aligned openings in vertical frame members in the lower and upper portions 72 and 74 of retainer 18, as shown best in FIG. 11. The pins 76 and 77 transfer forces between the portions of retainer 18 in use.

The lower portion 72 of the right retainer 18 includes the peripheral frame members 84, 86, 88 and 90 and the internal frame members 92, 94 and 96 which define the manifold opening 98 in the retainer 18. The frame members secured together as shown best in FIG. 11 are, for example, wooden members. A smooth panel 100 is provided over the frame members and supports the back end of the plastic liner 54 and bulk material therein in assembly. The smooth panel 100 may be fiberboard or the like and may be connected to the frame members by suitable means such as staples or the like.

The upper portion 74 of the right retainer 18 again includes the peripheral frame members 82, 106, 108 and 110 along with the interior frame members 112 and 114. Again, a smooth fiberboard panel 116 is secured over the frame members and is in alignment with the panel 100 with the pins 76 and 77 in position as shown in FIG. 11.

The left retainer 20, as shown in FIG. 7, includes the bottom portion 118, the upper portion 120, and the flap 122. The bottom portion 118 includes the peripheral frame members 124, 126, 130 and 132, and the inner frame member 134. Again, a fiberboard panel 136 is secured over the frame members for supporting the bag 54 in assembly.

A notch or tab 160 is provided on the panel 136. Notch 160 is adapted to fit behind the peripheral frame member 86 of the right retainer 18 in assembly, as shown best in FIG. 6.

The upper retainer portion 120 also includes the peripheral frame members 138, 140, 142 and 144 and an inner frame member 146. Again, a fiberboard panel 148 is secured to the frame members of the upper portion 120 of the left retainer 20. The flap 122 is an extension of the fiberboard panels 136 and 148. Flap 122 is secured to the panel 148 at the top thereof by a flexible web hinge member 150 which may be, for example, similar to seat belt webbing or the like. The retainer 20 shown in FIG. 7 also includes a flap 151 not present in the retainer 20 shown in FIG. 1. Flap 151 is again an extension of fiberboard panels 136 and 148 and is secured to the left side of the upper portion 120 of retainer 20 by a flexible web hinge members 153. In use, flap 151 closes the area between the upper portion of retainers 18 and 20.

The lower portion of retainer 20 is secured to the upper portion 120 by headed pins 152 extending through aligned openings 154 and 156 in peripheral frame members 130 and 138. The retainer portions 118 and 120 are further secured together by the flexible web members 158 and pins 155, as shown best in FIG. 7, extending therebetween. Thus, the left retainer 20 is foldable with the flaps 122 and 151 folded against the panel 148, and the panel 148 folded to engage the panel 136 with the pins 152 and 155 removed.

Brackets 102 and 162, bent as shown best in FIG. 6, are also provided on the lower portion 118 of the retainer 20 and are secured thereto by convenient means such as bolts 104 and 164. Brackets 102 and 162 are adapted to be secured to the retainer 18, again by convenient means such as the wing nuts 166 and 198, as shown best in FIG. 6.

The manifold 22, as shown best in FIG. 4, is constructed of a sheet of relatively rigid plastic material such as polypropolene, which is precut and pre-creased to be folded into the configuration illustrated. The manifold 22 in the assembled condition has a rectangular portion 168 which has a large end 170 and a small end 172. As shown best in FIG. 1, the sides 174 and 176 of the rectangular portion of the manifold 22 are not of equal length whereby the cylindrical portion 180 of the manifold 22 extends axially outwardly of the container 12 centrally of the opening for the door 34, substantially parallel to door 34 in a closed position. The cylindrical end 180 of the manifold 22 merges into the small end 172 of the rectangular portion 168 of the manifold 22, as shown. The manifold 22 in assembled configuration is secured together by the French pins 182.

The flange 184 is provided on the manifold 22 to permit securing of the manifold to the internal frame members 92, 94 and 96 of retainer 18 in the opening 98 by convenient means such as screws or the like 178. The portion 186 of the manifold 22 permits ready removal of bulk material on the bottom of the bag 54 through the manifold 22.

A rectangular plug 188 is provided in the rectangular portion 168 of the manifold 22 and is maintained in position therein by the removable peg 190. On removal of the peg 190 from the slots 192 therefor in the manifold, the rectangular plug 188 may be removed through the cylindrical end 180 to permit removal of bulk material from the container 12 through the sleeve 70 of the liner 54.

In assembly of the system 10 for retaining bulk material during shipping, the lower portion 72 of the right retainer 18 is first positioned with the left end 194 thereof adjacent the free edge of the door 32 in a locked position and with the right end 196 of the retainer 18 wedged against the liner 48 of the right container wall 28. The assembled retainer 20 is then positioned with the left edge thereof wedged against the liner 48 of the left container wall 26 and the retainers 18 and 20 are secured together by means of wing nuts 166 and 198.

The manifold 22 is assembled as shown in FIG. 4 and is then secured to the lower portion 72 of the retainer 18, following which the liner 54 is supported from the container top by the hanger straps 56, as shown. The sleeve 70 is positioned in the manifold 22 and the upper portion 74 of the retainer 18 is secured to the lower portion thereof by means of the pins 76 and 77.

If desired, when the ends of the retainers 18 and 20 are wedged against the liners 48 of the walls 26 and 28, as shown best in FIG. 5, they are secured in place against the liners by convenient means such as nails 200. In many instances, the nails 200 will not be necessary since the liner walls 48 deflect as shown best in FIG. 5 at 202, whereby the ends of the retainers are wedged in place without the necessity of the fastening nails 200.

With the retainers 18 and 20 secured together by the notch 160 extending behind the left end of the retainer 18 and the brackets 102 and 162 secured to both retainers, the retainer 18 is secured in position against movement toward the left or right side and the front of the container by any or all of three separate structures. Thus, as shown best in FIG. 2, a plastic tab 204 having a generally L-shaped configuration and an opening 205 therethrough may be secured to the bottom of the left end of the retainer 18 by convenient means such as nail 206 and extends between the door 32 and container bottom 44. A channel 207 having a cylindrical bushing 209 extending therethrough and secured thereto aligned with the opening 205 is welded to door 26. An abutment 211 is welded to the bottom of the container, and a stud 213 is provided secured to the abutment and extending through the holes in the tab and channel with the door 32 in a closed position as shown in FIG. 2. The tab also contains a warning to maintain the door 32 in a closed and locked condition any time the bag 54 is loaded. As shown best in FIG. 6, hook-shaped straps 208 may also be secured to the left end of the retainer 18 which extend around the free end 40 of the door 32 to secure the retainer 18 in its predetermined assembled position. Alternatively, bolts 210 may extend through the peripheral frame member 88 of retainer 18 and the bottom 44 of the container 12 to secure the retainer 18 in a fixed position within the container 12.

With the retainers and manifold in position, and the liner supported from the container, the container may then be loaded by blowing bulk material through the sleeve 62 and exhausting air from the sleeve 64. Air may also be exhausted through openings 215 in liner 54 which are covered by flaps 217. Openings 215 may be positioned in the top of liner 54 as required. With the liner 54 loaded, the sleeve 62 and sleeve 64 which are light, flexible material, may be closed by means of ties 71 secured thereto, and the door 34 closed and locked for shipment.

When it is desired to unload the bulk material, the door 34 is opened, the pin 190 is removed from the manifold 22, followed by removal of the plug 188. The bulk material from the liner 54 may then be removed through sleeve 70 and manifold 22.

The system for retaining bulk material during shipment 10 including the retainers 18 and 20, the manifold 22, the bag 54 and all the hardware necessary for the assembly thereof, as discussed above, may be packaged in a package not larger than 60×30×20 inches and shipped to a point of installation, as for example, baggage on an airliner or the like. Such a package as illustrated in FIG. 14 is also unique in that the plastic bag is protected without additional structural elements.

The package shown in FIG. 14 consists of the lower portion 72 of the retainer 18 positioned with the frame side in. The left retainer 20 is then folded, as shown, with the smooth surfaces in engagement with each other and positioned on the smooth surface of the portion 72 of retainer 18. The plastic liner 54 in a folded condition is then placed on top of retainer 20 together with manifold 22 in a flat condition and a bag 212 which may be secured to the packing straps 214 containing all the hardware necessary for the assembly of the members of the structure 10 including brackets, pins, nails, bolts and the like. The upper portion 74 of the retainer 18 is then positioned on top of the folded plastic bag with the frame side in as shown in FIG. 14 and the entire rectangular package is secured together by the packing straps 214.

In the modified structure illustrated in FIGS. 15–17, a plastic liner 216 is supported on a tubular frame 218 which is made up of a plurality of separate tubular members connected together at their intersections by tubular fittings 220. The tubular members and fittings are secured together by known structure as shown best in FIG. 17, wherein a spring member 222 is secured within the end of one tubular member 224, the end 226 of which has been reduced and telescoped into the end 228 of an axially aligned second tubular member 230. The spring 222 has a pin 232 secured to the end thereof. When the spring 222 is flexed, the pin 232 extends through the aligned openings 234 and 236 in the tubular members. The top of the tubular frame 218 passes through sleeves 238 positioned intermittently around the upper edges of the liner 216 on the interior thereof, whereby the liner 216 is completely supported by the frame 218. Entry into the liner 216 for construction of the frame 218 within the liner 216 may be through an opening 240 which is substantially closed by means of a zipper 242. Zipper 242 is protected by the flap 244 from bulk material within the bag 216. The zippered opening 240 may also be used to inspect bulk material within the liner 216 and may, of course, be provided in the liner 54, as shown in FIG. 15.

While one embodiment of the invention has been considered in detail together with modifications thereof, it will be understood that other embodiments and modifications of the system disclosed are contemplated. For example, it will be noted that sleeves 62, 64 and 70 are not essential and that the plug 188 is not necessary to the successful practice of the invention. It is the intention to include all such modifications and embodiments as are defined by the appended claims within the scope of the invention.

What is claimed is:

1. A bulk material retaining system comprising a generally rectangular parallelepipedic container including a top and bottom, right and left sides and front and back ends, wherein the back end of the container is an operable closure made generally of left and right doors mounted for pivotal movement about a vertical axis at the back end of the left and right sides respectively, a first retainer positioned vertically between the free end of the left door in a closed position and the right side of the container in spaced relation to the back end of the right side of the container, a second retainer positioned between firstly the left side of the container in spaced relation to the back end of the container and secondly along a continuous line extending upwardly first against the lower portion of the first retainer and then against the left door kept in a closed position, the second retainer being in a position vertically inclined toward the left side of the container and toward the left door kept in a closed position, a flexible liner supported within the container of substantially the same size as the container, said liner includes means for passing bulk material into it and evacuating air therefrom and means for discharging bulk material from the liner, and a manifold secured to the first retainer through which bulk material is discharged from the liner.

2. The retaining system as set forth in claim 1, wherein at least one of the retainers comprises a plurality of separate portions of integral plastic construction.

3. The retaining system as set forth in claim 1, wherein the first retainer comprises a lower portion including a peripheral frame on the back side thereof and a smooth panel on the front side thereof having an opening therein for receiving the manifold, an upper portion of the same general dimensions as the lower portion including a peripheral frame on the back side and a smooth panel on the front side thereof, and means for securing the portions of the retainer together one on top of the other with the panels aligned.

4. The retaining system as set forth in claim 3, wherein the means for securing the portions of the retainers together comprises openings in the peripheral frame at the top of the lower portion of the retainer and at the bottom of the upper portion of the retainer aligned with each other with the retainers positioned one on top of the other with the panels aligned, and pins extending through the aligned openings, said pins are located so that the peripheral frames contribute to one another in resisting bending under loads thereon developed by bulk cargo in the container when the container is subjected to longitudinal acceleration.

5. The retaining system as set forth in claim 1, wherein the second retainer includes a lower trapezoidal portion including a peripheral frame therearound on the back side thereof and a smooth panel secured to the frame on the front side thereof, an upper trapezoidal retainer portion including a peripheral frame on the back thereof and a smooth panel secured to the frame on the front thereof positioned on top of the lower retainer portion, a flexible hinge secured to the top of the lower retainer portion and to the bottom of the upper retainer portion, a trapezoidal smooth flap positioned on the upper retainer portion, and a flexible hinge secured to the top of the upper retainer portion and the bottom of the flap.

6. The retaining system as set forth in claim 5, wherein the second retainer further includes a triangular smooth flap positioned on the upper retainer portion and a flexible hinge secured to one side of the triangular flap and to one side of the upper retainer portion.

7. The retaining system as set forth in claim 5, wherein the top of the peripheral frame of the bottom retainer portion and the bottom of the peripheral frame of the top retainer portion have aligned openings extending therethrough with the bottom and top portions and panels aligned, and pins extending through the aligned openings, which pins are located so that the peripheral frames contribute to one another in resisting bending under loads thereon developed by bulk cargo in the container when the container is subjected to longitudinal acceleration.

8. The retaining system as set forth in claim 5, and further including brackets secured to the top and bottom of the lower portion of the second retainer adjacent the right end thereof, whereby the first and second retainers may be secured together.

9. The retaining system as set forth in claim 5, and further including an extension of the smooth panel of the bottom portion of the second retainer forming a notch extending from the upper right corner thereof adapted to extend behind the left edge of the first retainer, with the first and second retainers secured together, contributing to securing the first and second retainers together.

10. The retaining system as set forth in claim 1, wherein the means for discharging material from the liner includes a sleeve on the liner, a rectangular opening is provided through the first retainer of the bottom thereof and the manifold fits within the opening in the first retainer and extends rearwardly beyond the first retainer, said manifold is an elongated member having a larger rectangular front end portion including flanges therearound adapted to be secured to the inside of the rectangular opening through the first retainer, the manifold further includes a smaller rectangular central portion with the walls of the manifold between the larger and smaller rectangular portions being gradually diminished in size, and with one side wall being of less length than the other side wall, whereby the smaller rectangular portion is generally parallel to the back end of the container, said manifold still further including a circular rearmost end which merges with the smaller rectangular central portion of the manifold.

11. The retaining system as set forth in claim 10, wherein the manifold is constructed of precut semi-rigid material pre-creased for folding into the form recited, and is secured together by fastening means after being shipped flat.

12. The retaining system as set forth in claim 10, and further including a rectangular plug positioned in the rectangular portion of the manifold immediately adjacent the smaller rectangular central portion thereof, slots are included in the top and bottom of the manifold immediately adjacent the smaller rectangular portion thereof and rearwardly of the plug, and a notched peg is positioned in the slots to prevent movement of the plug rearwardly in the manifold under pressure exerted by bulk material in the liner.

13. The retaining system as set forth in claim 1, wherein the right side wall of the container includes vertically extending reinforcing members spaced apart between the front and back ends thereof and is flexible between the reinforcing members and wherein the right end of the first retainer is positioned between two of the vertical reinforcing members whereby with bulk material in the liner pressing against the first retainer, the right side wall between the two vertical reinforcing members flexes outwardly to wedge the right end of the first retainer in position against the right side of the container, thereby further securing the first retainer in place.

14. The retaining system as set forth in claim 1, and further including means for securing the adjacent ends of the retainers in position against movement toward or away from the back of the container and toward either the left or right side of the container.

15. The retaining system as set forth in claim 14, wherein the means for securing the adjacent ends of the retainers in position comprises a semi-rigid tab secured to the bottom of the left end of the first retainer and extending downward between the back end of the bottom of the container and the left door of the container when in a closed position so as to be wedged therebetween, said tab extending sufficiently below the door to carry visible embossed instructions to keep the left door closed during loading, shipping loaded and unloading of the container.

16. The retaining system as set forth in claim 15, and further including a channel secured to the left door at the free edge thereof extending below the bottom of the door and having an opening therethrough, an abutment secured to the bottom of the container aligned with the portion of the channel below the door, the tab has an opening therethrough aligned with the opening in the channel and a headed stud fixed to the abutment extends through the aligned openings in the channel and tab with the left door in a closed position.

17. The retaining system as set forth in claim 14, wherein the means for securing the adjacent ends of the retainers in position comprises at least one thin formable strap secured to the left end of the first retainer and bent around the free edge of the left door in the form of a hook with the left door in a closed position.

18. The retaining system as set forth in claim 14, wherein the means for securing the adjacent ends of the retainers in position comprises at least one bolt extending through the peripheral frame at the bottom of the first retainer and through the floor of the container.

19. Structure as set forth in claim 1, further including means for entry into the liner including an opening in the liner, a zipper for closing the opening in the liner, and a rearwardly extending flap over the length of the zipper on the inside of the liner to prevent bulk material from jamming the zipper.

* * * * *